US006164903A

United States Patent [19]

Kouris

[11] Patent Number: 6,164,903

[45] Date of Patent: Dec. 26, 2000

[54] TURBINE VANE MOUNTING ARRANGEMENT

[75] Inventor: Konstantino Kouris, Madison, Conn.

[73] Assignee: United Technologies Corporation, Hartford, Conn.

[21] Appl. No.: 09/218,351

[22] Filed: Dec. 22, 1998

[51] Int. Cl.[7] ..... F01D 9/04; F01D 25/26

[52] U.S. Cl. ..... 415/135; 415/138; 415/189; 415/200; 415/209.2; 415/209.4; 415/209.3

[58] Field of Search ..... 415/135, 136, 415/137, 138, 189, 190, 200, 209.2, 209.4, 209.3

[56] References Cited

U.S. PATENT DOCUMENTS

| | | | |
|---|---|---|---|
| 2,914,300 | 11/1959 | Sayre | 415/135 |
| 3,394,919 | 7/1968 | Catterfeld | 415/138 |
| 5,630,700 | 5/1997 | Olsen et al. | 415/135 |
| 5,634,767 | 6/1997 | Dawson | 415/135 |
| 6,000,906 | 12/1999 | Draskovich | 415/209.4 |

FOREIGN PATENT DOCUMENTS

| | | | |
|---|---|---|---|
| 62-41903 | 2/1987 | Japan | 415/209.3 |
| 63-223302 | 2/1987 | Japan | 415/200 |

*Primary Examiner*—Christopher Verdier
*Attorney, Agent, or Firm*—John Swiatocha

[57] ABSTRACT

A ceramic turbine inlet vane(s) is resiliently mounted to stator portions (10) and (15) of a gas turbine engine by outer and inner resilient mounts (20) and (25). The resilient mounts each include springs, which accommodate varying rates of radial and axial thermal expansion between the vane and adjacent metallic stator structure.

5 Claims, 2 Drawing Sheets

FIG. 1
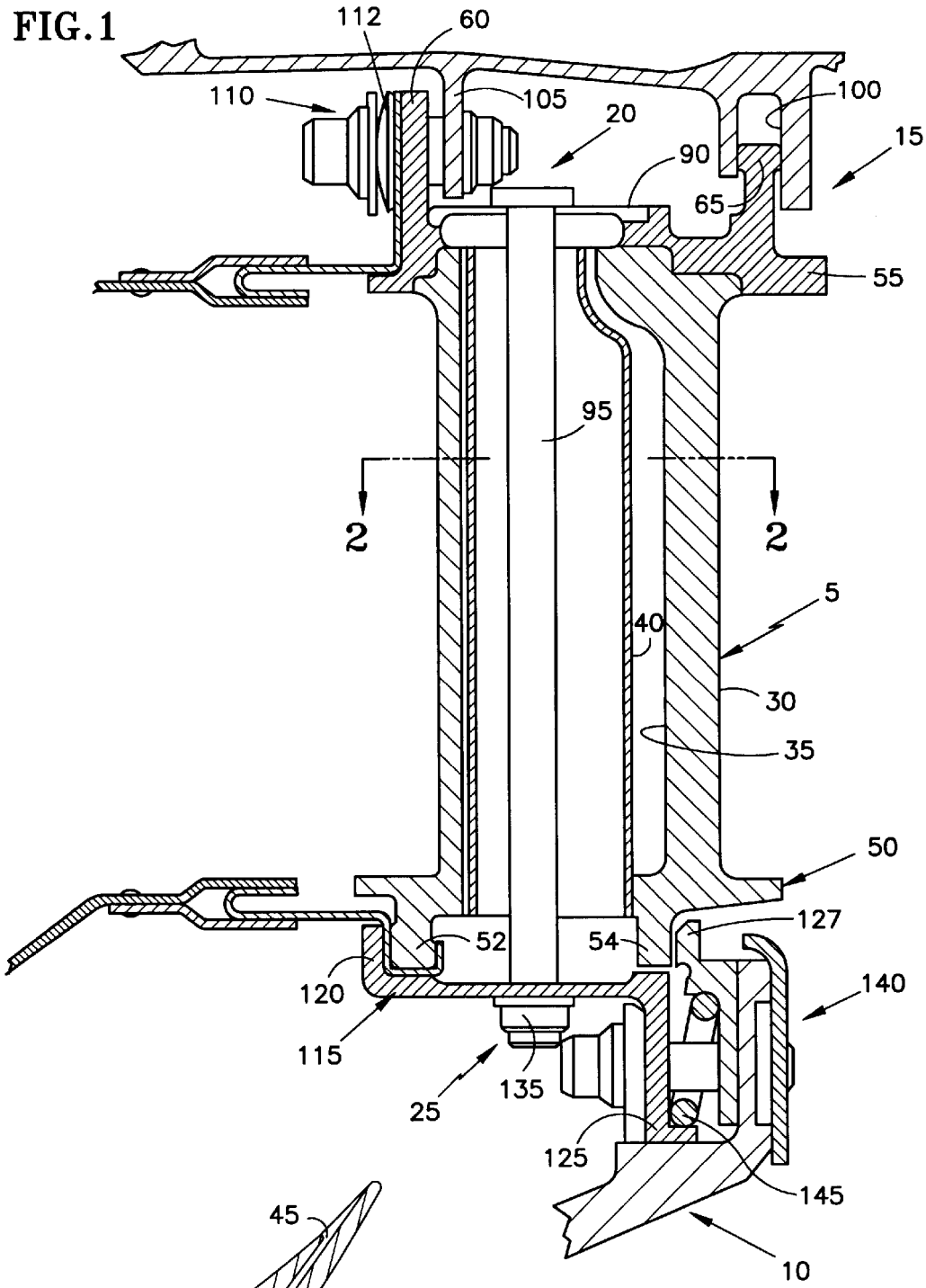
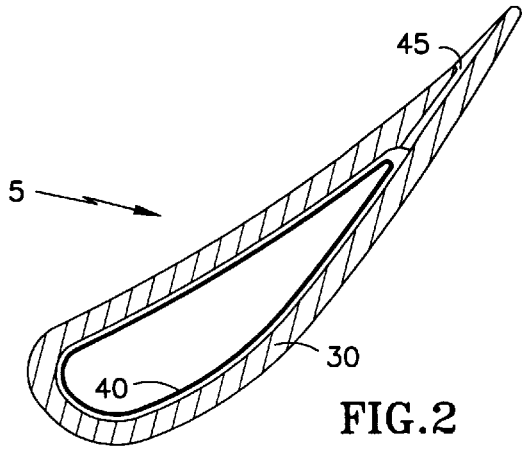
FIG. 2

TURBINE VANE MOUNTING ARRANGEMENT

TECHNICAL FIELD

This invention relates to an arrangement for mounting a turbine vane in a gas turbine engine, and more particularly, to such an arrangement for mounting a ceramic vane in the turbine inlet of an industrial gas turbine engine.

BACKGROUND ART

Turbine inlet (compressor discharge) temperatures for gas turbine engines such as industrial gas turbines, which are used for pumping, the generation of electricity and the like are extremely high, being on the order of 1300–1400° C. In order to withstand such extreme temperatures, it has been the practice to provide metallic turbine blades and vanes with internal cooling. That is, such blades and vanes are provided with a very intricate network of internal passages through which compressor discharge cooling air flows, to remove heat from the interior of the blade or vane. The external surfaces of such components are cooled with cooling air discharged from the internal passages, which flows as a film over the surface of the component to carry away heat therefrom and then enters the flow of working fluid exiting the engine's combustor. Such blades and vanes are also coated with various highly temperature resistant ceramic and metallic coatings, which further aid these components in withstanding the extreme temperatures encountered at the turbine inlet.

Such internally cooled blades and vanes tend to be very expensive to produce owing in large measure to the complexity of the internal cooling air passages and the costly materials employed in the coatings. Moreover, such blades and vanes require very high volumes of cooling air to withstand the extreme turbine inlet temperatures set forth above and therefore detract significantly from the overall efficiency of the engine in that such cooling air is unavailable to support combustion within the engine and therefore cannot be used directly by the engine to produce power. Furthermore, the relatively high volumes of cooling air which enter the flow of working fluid exiting the engine's combustor, react with the products of combustion to produce excessive quantities of nitrous oxides, undesirable pollutants which are sought to be minimized.

Efforts to overcome these deficiencies in state-of-the-art metallic vanes have led to the suggestion of vanes formed entirely of ceramic, with a simple, hollow interior cooled by an impingement of cooling air against the inner surface of the vane. Such a simple interior cooling arrangement is significantly less costly to manufacture than the complex arrangements of cooling passages in current metallic vanes. Moreover, the ceramic material itself from which the blade is formed, typically a silicon nitride or similar material, is less costly than the rather exotic metallic materials employed in state-of-the-art vanes. However, such ceramic vanes typically have coefficients of thermal expansion far less than those of metallic materials from which the associated stators are constructed. Thus, mounting such vanes to such metallic stators has heretofore been impossible without the vanes loosening from their mounts due to the differing rates at which the vanes and stator structures expand and contract during the operation of the engine.

DISCLOSURE OF THE INVENTION

Accordingly, it is an object of the present invention to provide a mounting arrangement for a turbine vane wherein the vane is securely held to an associated stator structure without risk of loosening due to variations in coefficients of thermal expansion between the vane and stator structure.

In accordance with the present invention, a vane is fixed to associated turbine stator structure at opposite ends of the vane by resilient mounts, at least one of which is compliant in a radial direction for accommodating the disparate rates of radial thermal expansion between the vane and the stator structure, and at least one of which is compliant in an axial direction for accommodating disparate rates of axial thermal expansion between the vane and the stator structure. In the preferred embodiment, one of the mounts, preferably that disposed at the radially outer end of the vane comprises a radially compliant contoured spring plate compressively attached to a metallic shroud which fits over the end of the vane, by a radial bolt extending through the hollow interior of the vane. At the radially inner end of the vane, which is provided with an integral inner shroud, the radial bolt compressively attaches a second spring plate to the vane. The second spring plate is provided with a mounting flange by which the second spring plate is attached to the radially inner portion of the stator structure. This attachment of the second spring plate to the inner portion of the stator structure is preferably preloaded by a compression spring to maintain the integrity of the connection throughout a wide range of thermal conditions within the turbine.

The mounting arrangement of the present invention maintains the integrity of the connection of the vane with the turbine stator despite the differences in the coefficient of thermal expansion between those two elements. The advantages of ceramic vanes, namely, the ability to withstand extreme turbine inlet temperatures with minimal amounts of cooling air, and therefore the attendant efficiencies in engine operation and low emissions of nitrogen oxide pollutants are thus attainable with the present invention.

Furthermore, an unexpected advantage of the present invention is that the attachment of the ceramic vane to the resilient mounts, loads the vane in compression. Since ceramics are much stronger in compression than in tension, the compressive preloading of the vane reduces the resultant tensile loads experienced by the vane during operation, thereby effectively strengthening the vane and rendering it more able to withstand the aerodynamic and vibratory loading thereof, associated with normal engine operating conditions.

DESCRIPTION OF THE DRAWINGS

FIG. 1 is a sectioned elevation of a turbine vane mounting arrangement of the present invention.

FIG. 2 is a sectional view taken in the direction of line 2—2 of FIG. 1.

BEST MODE FOR CARRYING OUT THE INVENTION

Figure 3:
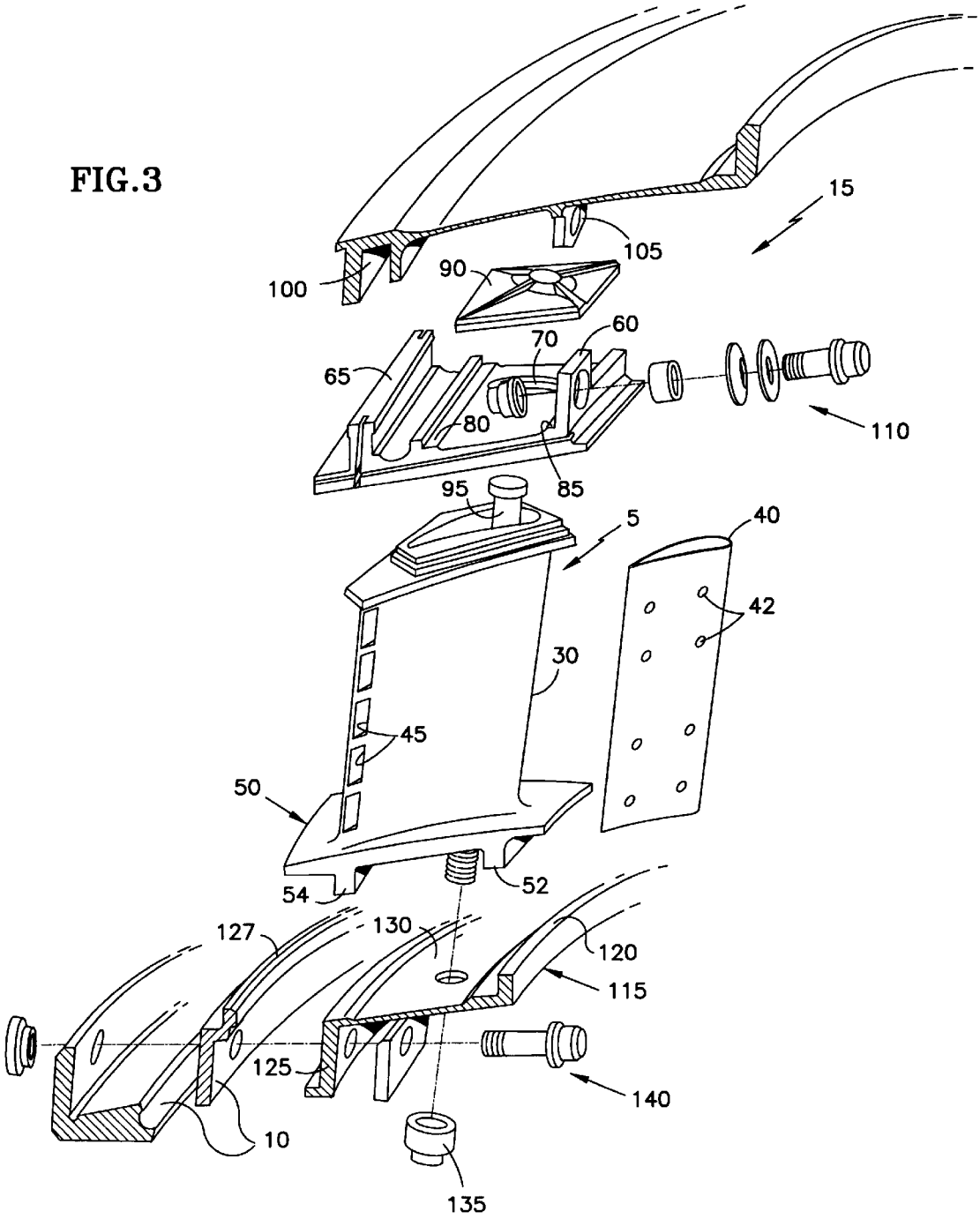
FIG. 3 is an exploded perspective view of the turbine vane mounting arrangement of the present invention.

Referring to the drawings, a turbine inlet stator vane 5 formed from silicon nitride or other similar ceramic material is mounted to inner and outer portions of the engine stator structure 10 and 15, respectively, by first and second resilient mounts 20 and 25 located at the radially outer and inner ends of the vane, respectively.

Inlet vane 5 comprises a hollow airfoil portion 30 having a generally uniformly thick sidewall structure defining a chamber 35 the interior of which receives cooling air from the engine's compressor (not shown) in a manner well known in the art, to extract heat from the vane. As best seen in FIG. 2, a sheet-metal baffle 40 generally concentric with the surface of chamber 35 and spaced inwardly therefrom is provided with cooling holes 42 therein which direct the cooling air into impingement with the inner surface of the vane in a manner well known in the art. From the inner surface of the vane, the cooling air passes outwardly through holes 45 (see FIG. 2) in the vane's trailing edge. Vane 5 is also provided with an integral, radially inner shroud 50 having radially outwardly extending flanges 52 and 54.

First, (radially outer) mount 20 comprises a metallic shroud 55 having a pair of opposed radially outerwardly extending mounting flanges 60 and 65 integral therewith and a recessed mounting hole 70 disposed between opposed shoulders 80 and 85 (see FIG. 3). Mount 20 also includes a contoured and ribbed first spring plate 90 formed from any of various high temperature metals having an appropriate spring constant, such as nickel based alloy IN718, which is seated on shoulders 80 and 85 and compressively retained thereagainst by a radial bolt 95 extending through the interior of the vane and baffle. Shroud flange 65 is received within a mating groove 100 in radially outer stator portion 15, while flange 60 is bolted to apertured stator flange 105 by a bolted connection 110 including spring washer 112.

The second (radially inner) resilient mount 25 comprises a second resilient spring plate 115 is formed from any of various high temperature metals having an appropriate spring constant, such as the aforementioned IN718 alloy. Second spring plate 115 includes a radially inwardly extending flange 120 and radially outwardly extending flange 125 and an apertured medial portion 130 through which bolt 95 extends, the bolt being compressively held thereto by nut 135. Second resilient mount includes a spring plate 115 is attached to radially inner stator portion 10 by a bolted connection 140 therewith. A helical (or alternately a belleville) compression spring 145 is captured between flange 125 and stator structure 10 whereby the bolted connected may be maintained in a tightened (preloaded) condition to maintain the integrity of the connection and to maintain the axial compressive preloading of the vane at flanges 52 and 54 which are captured and secured between flange 120 of spring plate 115 and flange 127 of stator portion 10.

It will be seen that vane 5 is connected to radially outer stator portion 15 by means of first spring plate 90 and shroud 55. Accordingly, a difference in radial thermal expansion and contraction between vane 5 and stator structure 15 are accommodated by flexure of this spring plate such that the vane will not loosen at its outer end due to such differences in thermal expansion and contraction. It will also be seen that radial flexure of the medial portion 130 of second spring plate 115 will accommodate differences in radial expansion and contraction between the vane and the radially inner portion 10 of the stator structure. Axial flexure of the second spring plate at flanges 120 and 125 will accommodate axial differences in thermal expansion and contraction between the vane and the radially inner portion of the stator structure. Spring 145 and spring washer 112 maintain the integrity of the bolted connections 110 and 140 and ensure that preloading of those connections are maintained during operation of the engine in which vane 5 is employed.

It will be appreciated that mounts 20 and 25 will ensure that ceramic vane 5 remains firmly attached to the engine's stator throughout a wide range of operating temperatures without the vane loosening. Thus, with the present invention, the attributes of ceramic turbine inlet vanes may be reliably achieved in gas turbine engines. Such vanes may be cooled with smaller quantities of cooling air than state of the art metallic vanes, thereby enhancing the output power produced by the engine, and thus the overall efficiency thereof. Minimizing the amount of cooling air required in the vane also reduces the production of nitrous oxide pollutants produced by the engine. The compressively preloaded bolted connections effectively reduce the resultant tensile loading experienced by the vane which, as set forth hereinabove, is significantly weaker in tension than compression.

While a particular embodiment of the present invention has been shown and described, it will be appreciated that various alternative approaches to the present invention suggest themselves to those skilled in the art. For example, while specific materials and spring configurations have been illustrated and described, alternate materials and configurations may be employed without departing from the present invention, as structural configurations of the remainder of the engine and the operating parameters thereof dictate. Furthermore, while direct connections between ceramic and metallic components have been illustrated, ceramic cloth, such as that sold under the trademark Nextel, may be employed between such connections to minimize corrosion. It is intended by the following claims to cover any and all such alternatives as fall within the true spirit and scope of this invention.

What is claimed is:

1. An arrangement for mounting a vane airfoil having a shroud to a gas turbine engine stator structure having radially inner and outer portions, said mounting arrangement characterized by:

a first, radially compliant, resilient mount by which said vane, at one end thereof, is mounted to one of said stator portions, said first resilient mount comprising a first spring;

a second resilient mount by which said vane airfoil is mounted at an opposite end thereof to the other of said stator portions, said second resilient mount comprising a spring plate being radially and axially compliant;

at least one fastener engaging said vane and said first and second resilient mounts for securing said vane to said first and second resilient mounts and said first and second resilient mounts to said stator structure;

said second resilient mount being fixed to said shroud by said fastener, and adapted for attachment at a mounting flange thereof, to said stator structure by a second fastener, and further comprising a third spring disposed between said mounting flange and stator structure;

wherein said mounting arrangement is compliant in a radial direction for accommodating disparate rates of radial thermal expansion between said vane and said stator structure, and at least one of said resilient mounts is compliant in an axial direction, accommodating disparate rates of axial thermal expansion between said vane and said stator structure.

2. The mounting arrangement of claim 1 characterized by:

said first resilient mount further including a mounting shroud disposed at one end of said vane airfoil, said mounting shroud being adapted for attachment to said stator structure;

said fastener extending generally radially onto the interior of said vane; and said first spring being held in compressive engagement with said airfoil and said first shroud by said radially extending fastener.

3. The mounting arrangement of claim 1 characterized by said first spring comprising a first spring plate.

4. The stator vane mounting arrangement of claim 1 characterized by said third spring being axially preloaded by said second fastener for maintaining the integrity of the connection between said second shroud and said stator structure under varying thermal conditions.

5. The mounting arrangement of claim 4 characterized by said second spring comprising a helical spring.

* * * * *